US006252479B1

(12) United States Patent
Kern et al.

(10) Patent No.: US 6,252,479 B1
(45) Date of Patent: Jun. 26, 2001

(54) ELECTROMAGNETIC RELAY AND PROCESS FOR PRODUCING THE SAME

(75) Inventors: Josef Kern; Angelo Polese, both of Berlin (DE)

(73) Assignee: Tyco Electronics Logistics AG, Steinach (CH)

( * ) Notice: Subject to any disclaimer, the term of this patent is extended or adjusted under 35 U.S.C. 154(b) by 0 days.

(21) Appl. No.: 09/214,731

(22) PCT Filed: Jun. 17, 1997

(86) PCT No.: PCT/DE97/01230

§ 371 Date: Jan. 11, 1999

§ 102(e) Date: Jan. 11, 1999

(87) PCT Pub. No.: WO98/01880

PCT Pub. Date: Jan. 15, 1998

(30) Foreign Application Priority Data

Jul. 10, 1996 (DE) ..... 196 27 844

(51) Int. Cl.[7] ..... H01H 51/22
(52) U.S. Cl. ..... 335/80; 335/124
(58) Field of Search ..... 335/71–80, 124, 335/128

(56) References Cited

U.S. PATENT DOCUMENTS

| | | | | |
|---|---|---|---|---|
| 4,032,871 | | 6/1977 | Sauer . | |
| 4,185,163 | * | 1/1980 | Schedele | 335/202 |
| 4,307,362 | * | 12/1981 | Kobler et al. | 335/202 |
| 4,499,442 | | 2/1985 | Kamo et al. . | |
| 4,827,234 | | 5/1989 | Weiser et al. . | |
| 4,975,666 | * | 12/1990 | Nobutoki | 335/78 |
| 5,038,123 | * | 8/1991 | Brandon | 335/128 |
| 5,148,136 | * | 9/1992 | Kidd | 335/78 |
| 5,191,306 | * | 3/1993 | Kaji et al. | 335/78 |
| 5,250,919 | | 10/1993 | Schedele . | |

FOREIGN PATENT DOCUMENTS

| | | |
|---|---|---|
| 0 251 035 | 1/1988 | (EP) . |
| 0 531 890 | 3/1993 | (EP) . |
| 1598789 | 7/1970 | (FR) . |
| 2 301 085 | 9/1976 | (FR) . |
| 2 352 469 | 12/1977 | (FR) . |
| 1 333 968 | 10/1973 | (GB) . |
| WO 91/07770 | 5/1991 | (WO) . |

* cited by examiner

*Primary Examiner*—Lincoln Donovan
(74) *Attorney, Agent, or Firm*—Schiff Hardin & Waite

(57) ABSTRACT

The relay comprises a first housing part in which a coil having a U-shaped core is embedded, as well as a second housing part in which at least one spring support as well as at least one mating contact element are anchored. A contact spring with a flat armature is attached to the spring support. The relay is adjusted and additionally sealed by joining the two half-shells.

19 Claims, 5 Drawing Sheets

FIG 5
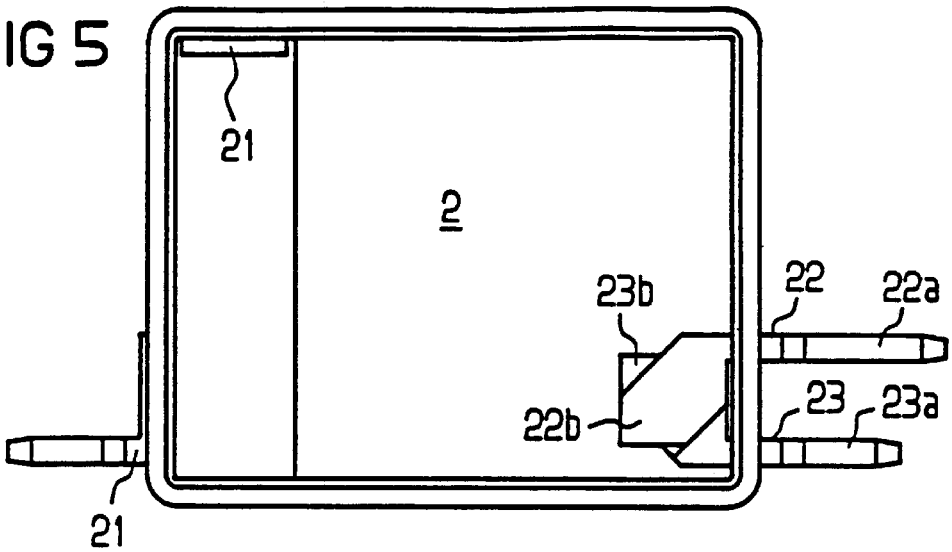
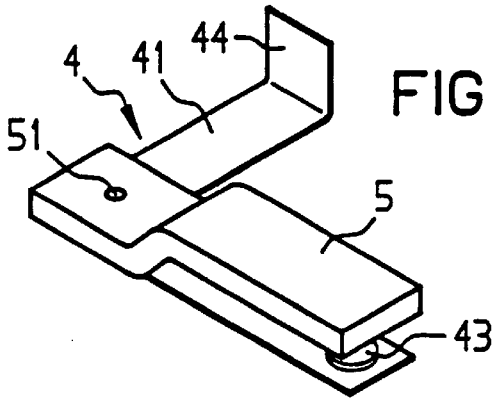
FIG 6
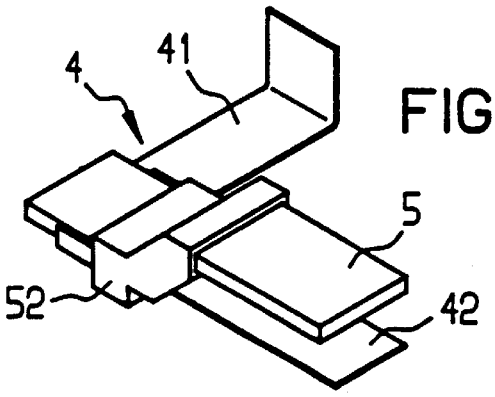
FIG 7

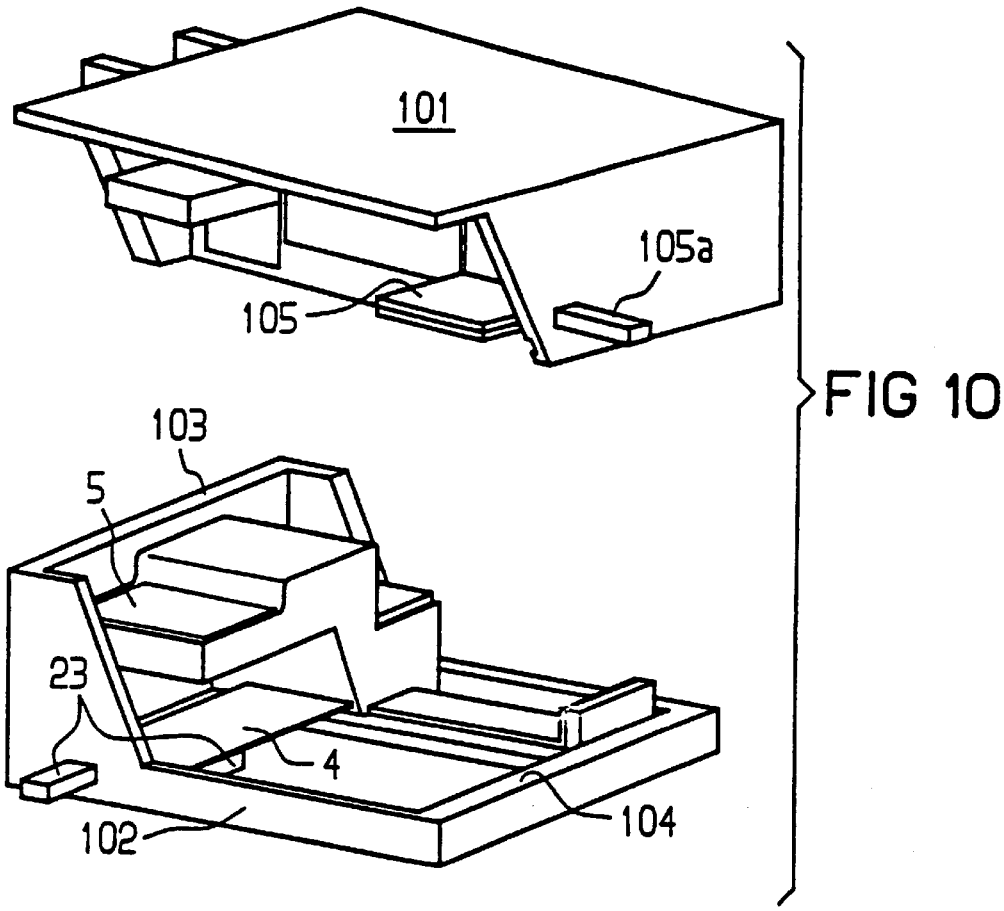
FIG 10
FIG 11
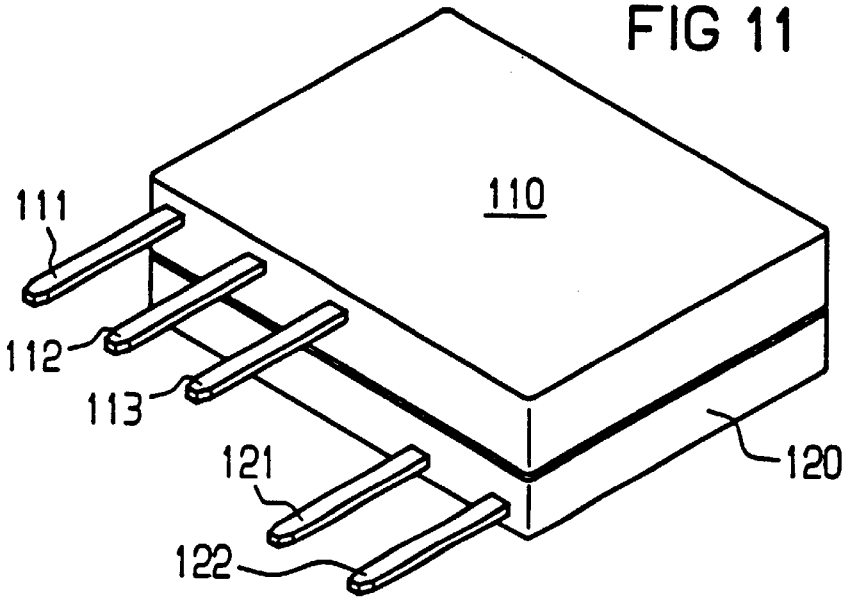

ELECTROMAGNETIC RELAY AND PROCESS FOR PRODUCING THE SAME

BACKGROUND OF THE INVENTION

The invention relates to an electromagnetic relay having a first housing part, which is fitted with a coil as well as a core which passes through the coil and, outside the coil, forms pole plates at its two ends, a second housing part in which at least one spring support and at least one mating contact element are anchored, the spring support being fitted with a contact spring which interacts with the mating contact element, and an armature which is connected to the contact spring and bridges the pole plates forming air gaps.

In addition, the invention relates to a method for producing such a relay.

EP 0 531 890 A1 describes a switching relay which is in principle constructed in the manner described initially. There, however, the two housing parts do not form a closed housing but only a base which is preferably a printed circuit board having an integrally formed side wall, and a cover part between which a large housing gap remains open even after the two parts have been joined together. The relay is preferably designed as a multiple relay having a row of magnet systems located alongside one another, a common core pole plate being located on the base and forming a row of vertically projecting core sections onto each of which a coil is fitted. Each system also has a U-shaped armature which is mounted on a core pole plate and, with the contact spring, encloses the coil like a frame. The cover part has slits with inserted mating contact elements and spring supports, and these slits likewise are not sealed. There, the contacts are clearly adjusted through the large housing opening in the region of the contacts.

WO 91/07770 has already disclosed a relay in which the magnet system is fixed in the upper region of a housing, while a contact system is pushed in from the open underneath until the contact closes when the magnet system is energized. Once this contact system has been pushed in further by a predetermined amount in order to produce a desired overtravel, it is fixed in the housing. This allows manufacturing tolerances to be compensated for even at the assembly stage, so that there is no longer any need for a subsequent adjustment.

DE-A-2 506 626 discloses a contact support for switching elements, which contact support can be closed by a housing and is composed of a dielectric. Armature contacts are mounted either in a glass tube or in a plastic frame as a support, and this support is closed on the outside by two housing caps. All the moving parts are housed there in one and the same support part, while the housing caps have no influence on the positioning of the functional elements of the relay.

EP-A-0 251 035 furthermore discloses a relay which comprises two base body parts which are in the form of half-shells, form a coil former and are fitted with the winding. Two pole plates are embedded in a common plane in one of the base body parts, and their ends are bridged in a contact space within the coil by means of an armature contact. The armature itself is fixed by a spring, in the form of a frame, which is in the separating plane between the two base body parts.

SUMMARY OF THE INVENTION

The aim of the present invention is to provide a relay of the type mentioned initially and having a flat design, which is designed for different sizes and applications and which can be produced in large quantities very cost-effectively, using the appropriate manufacturing methods. At the same time, a high degree of accuracy is intended to be achieved as early as the manufacturing stage by virtue of the design, so that the relay characteristics are maintained with only small tolerances, even without subsequent adjustment.

This aim is achieved according to the invention in the case of such a relay in that the two housing parts, which are joined together at their edges to form a seal, are roughly trough-shaped half-shells made of plastic, while the connections for the coil winding and for the contact elements are each passed out through the walls of their respective housing parts, and in that the main joint planes between the two housing parts are at right angles to the switching movement of the contact spring.

In the case of the relay according to the invention, the two half-shells not only form a housing which is easy to seal, but they are also used as support for the functional elements of the relay, and these functional elements, that is to say the magnet system in the one part and the contact system in the other part, can be positioned very accurately as early as during the manufacture of the respective half-shell. The main joined planes between the two housing parts are preferably at right angles to the switching movement of the contact spring, so that the distance between the magnet system and the contacts can be adjusted by the joining together of the two housing parts. The fixing of the functional parts in the housing and the sealing of the connections are achieved particularly easily by embedding them in the respective housing half-shell. The joint planes are composed of plastic, preferably a thermoplastic, so that a sealed connection can be produced, for example by means of ultrasound, in a simple manner.

In one preferred embodiment, the magnet system is formed by a U-shaped core yoker plate, which is preferably embedded in a plastic coil former in the same way as at least two coil connections. The pole plates which are formed at the two ends of the core then extend at right angles to the core axis in the region alongside the coil, where they are bridged by an armature which is located alongside the coil. This armature may be designed to a greater or lesser extent as a flat metal sheet or may be bent at different levels at the two ends in order to interact with the pole plates, which are likewise correspondingly offset in height. This makes it possible to optimally utilize space in the housing to accommodate the contacts and the various connections. An L-shaped contact spring has one limb which extends at the end in front of the coil and the other or second limb which extends alongside the coil underneath or above the armature, and this structure results in a long spring length in a confined space. The armature is preferably attached to the contact spring in the transition region between the two spring limbs.

A preferred method for producing the relay, according to the invention, comprises the first housing part being produced by embedding the coil with the core including the coil connections, by the second housing part being produced by embedding the spring support and at least one mating contact element, by the contact spring, which is connected to the armature, being connected to the spring support, and by the edges of the two housing parts then resting on one another and being connected. In this case, the coil former is preferably also formed in advance by embedding the core and the coil connections, the first housing part being produced by a second embedding process after the winding of the coil and after the connection of the coil ends to the coil connections. Before the two housing parts are joined together, the armature is connected to the contact spring, an electrically conductive connection being possible by welding or the like, or an insulating connection by means of extrusion coating, depending on the application. The contact spring is then electrically conductively attached to the spring support which is anchored in the second housing part, for example by welding or else via a plug-in attachment.

A major advantage of the invention may also be regarded as being that the contact overtravel can be adjusted during the process of joining the two housing parts in that, the seal-in voltage of the armature is measured for example during the joining process, and the joining process is then interrupted when a predetermined seal-in voltage electrical characteristic is. This characteristic is a measure of the amount of erosion or the overtravel of the contact. Instead of being connected by ultrasound or some other welding method, the two half-shells can alternatively be sealed using other technologies, for example by bonding, clamping, potting or by means of an elastomer seal which is molded on using a two-component injection-molding method.

The invention will be explained in more detail in the following text using exemplary embodiments and with reference to the drawings.

DESCRIPTION OF THE DRAWINGS

FIG. 5 shows a plan view of the second half-shell of FIG. 4, without the armature, FIG. 6 shows an armature welded to a contact spring, FIG. 7 shows an armature connected to the contact spring by an extrusion coating, FIG. 10 shows a relay somewhat modified from that in FIG. 1, during the process of joining the two half-shells, and FIG. 11 shows a further modification of the relay of FIG. 1 with a different connection configuration.

DESCRIPTION OF THE PREFERRED EMBODIMENTS

Figure 1:
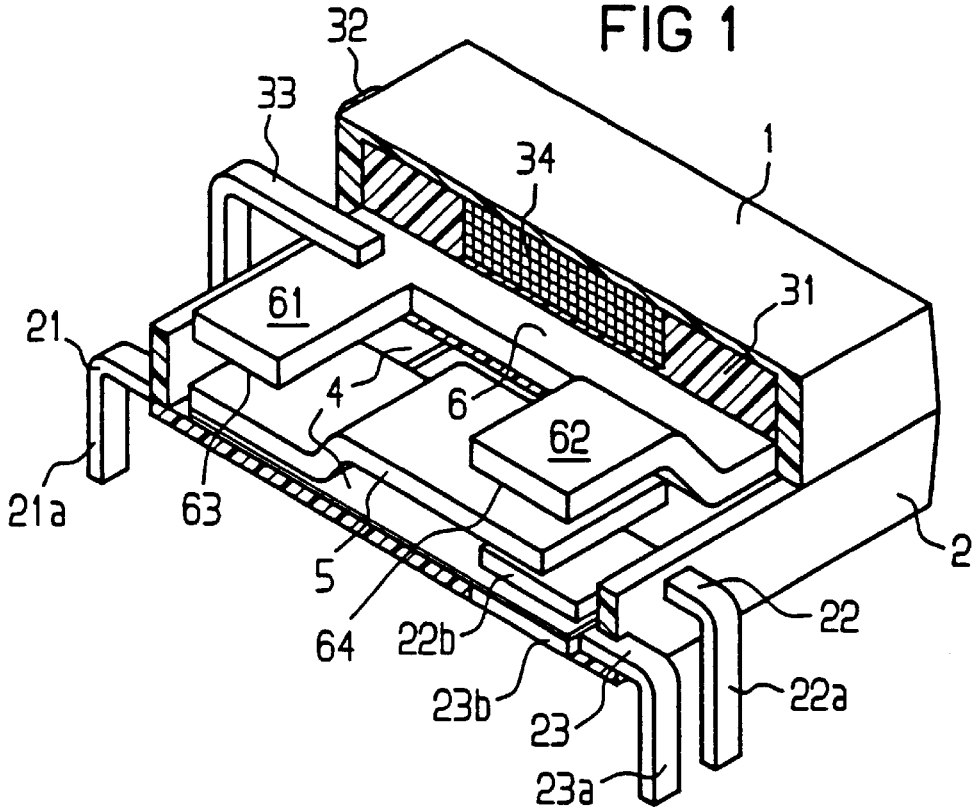
FIG. 1 shows a relay designed according to the invention, with the housing partially cut away.
Figure 2:
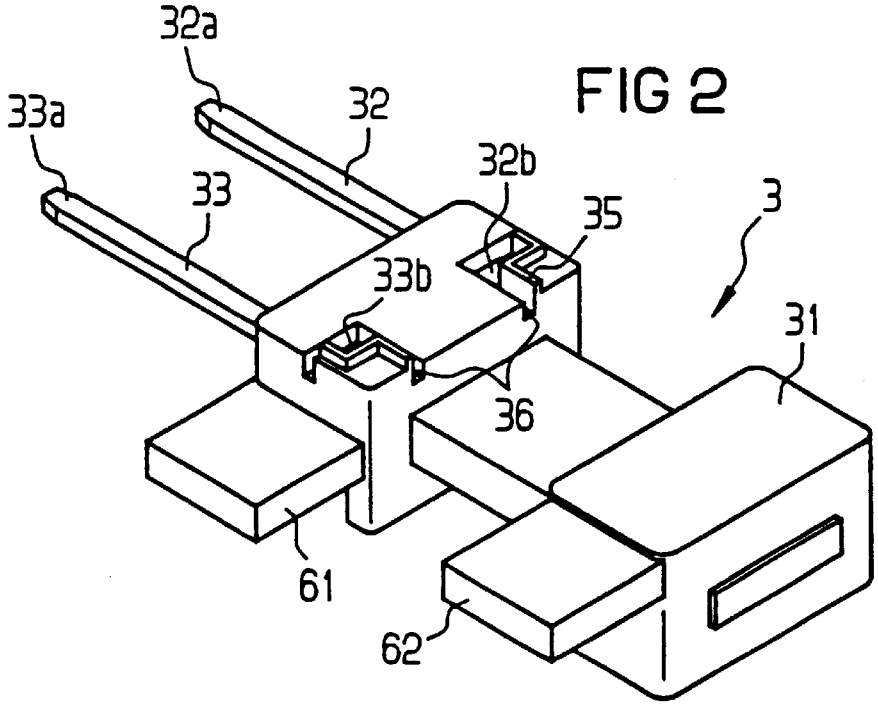
FIG. 2 shows a coil for the relay in FIG. 1.
Figure 3:
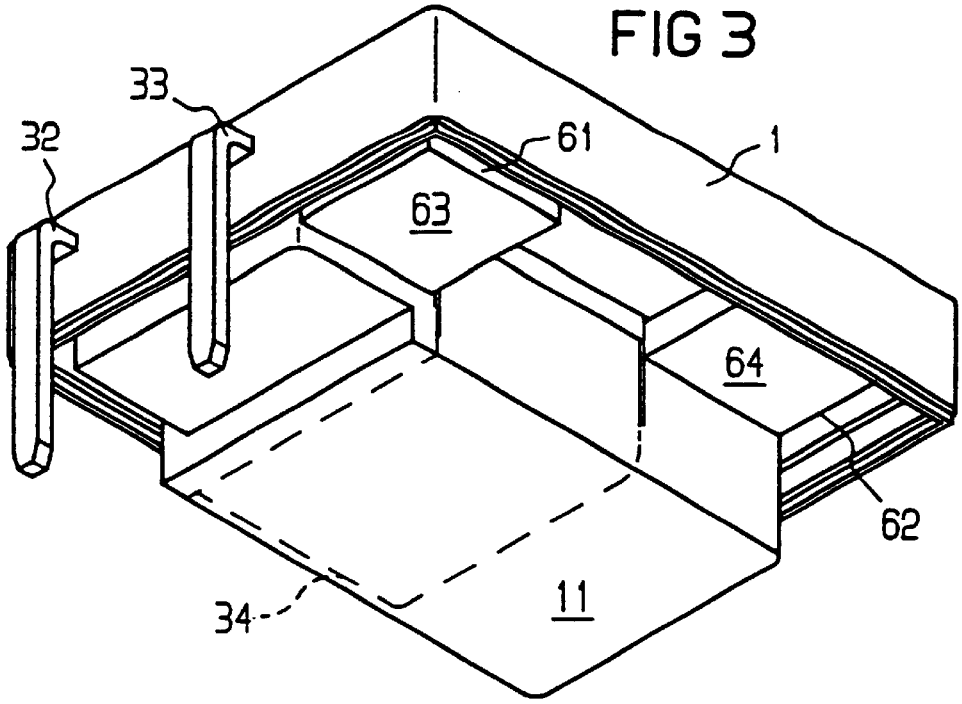
FIG. 3 shows a first half-shell which is produced by extrusion coating of the coil.
Figure 4:
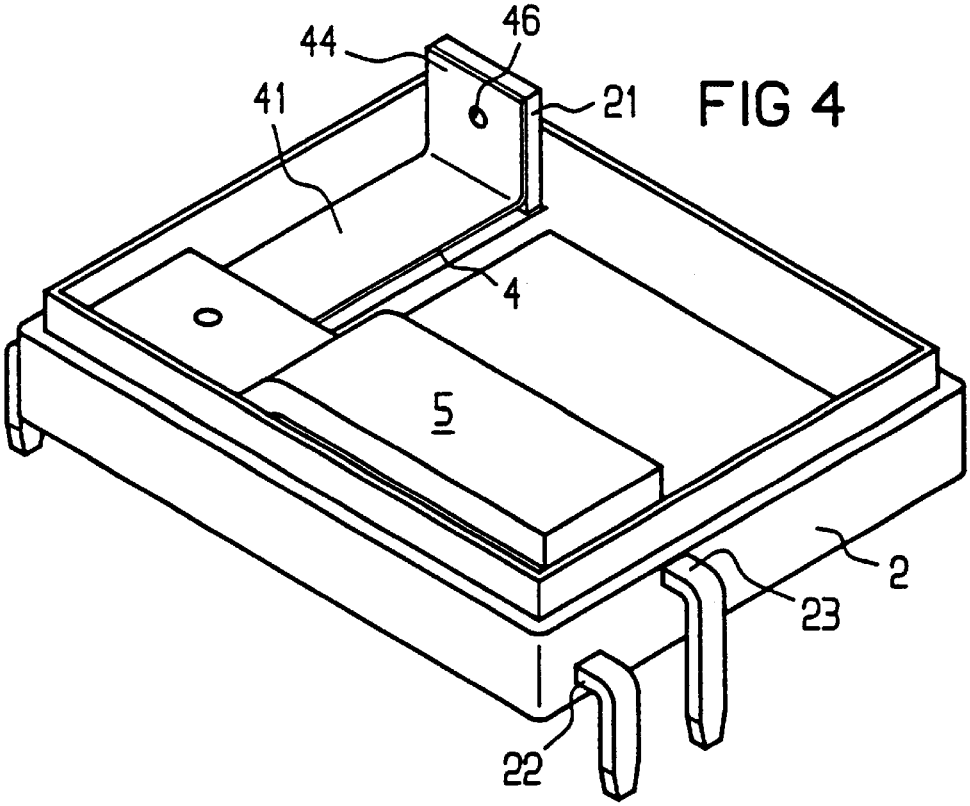
FIG. 4 shows a second half-shell with the armature inserted.

The relay shown in FIGS. 1 to 5 comprises a first half-shell 1 and a second half-shell 2. The half-shell 1 is formed by extrusion coating of a coil 3, and the second half-shell is formed by extrusion coating of a spring support 21 as well as mating contact elements 22 and 23. An L-shaped contact spring 4 is attached to the spring support 21 and, for its part, is fitted with an armature 5. Each of the ends of the armature 5, which is bent roughly in a Z-shape, forms an air gap with two pole surfaces 63 and 64 of the pole plates 61 and 62, which are part of a U-shaped core 6, but in which case the pole plate or core 6 and plate 61 62 is bent upward out of the core plane.

During manufacture, the coil is produced first of all by extrusion coating the center section of the core 6 with a thermoplastic, thus forming a coil former 31. The pole plates 61 and 62 are kept free during this process. Furthermore, two coil connections 32 and 33 are molded into the coil former, to be precise such that not only the connecting pins 32*a* and 33*a* which point outward but also the inner connecting surfaces 32*b* and 33*b*, which are intended to make contact with the winding ends, remain free of the embedding agent. After a coil winding 34 has been fitted on the coil former, the ends of the winding are connected to the connecting surfaces 32*b* and 33*b*. The winding ends are in this case routed such that they are protected behind ribs 35 in channels 36 in the coil former. The entire coil is then once again extrusion coated, in order in this way to produce the first half-shell according to FIG. 3. The pole surfaces 63 and 64 of the pole plates 61 and 62 also remain free of this extrusion coating, while the other parts, in particular the coil winding 34 as well, are embedded in the plastic 11 of the first half-shell 1. The coil connecting pins 32*a* and 33*a* are passed to the outside in a sealed manner in this repeated embedding process, where, according to FIG. 1 or FIG. 3, they can be bent downward into the shape of the pins 32 and 33 or, in a manner not illustrated, they can also be bent in a horizontal plane in order to form connections for surface-mounted devices.

As already mentioned, the second half-shell 2 is produced by extrusion coating of the spring support 21 and the mating contact elements 22 and 23, with a cavity being left free for the coil and the moving armature/contact spring unit. In this case, each of the mating contact elements has a connecting pin 22*a* or 23*a*, respectively, which is routed in a sealed manner to the outside, while fixed contact sections 22*b* and 23*b*, respectively, in the interior are each provided with a noble-metal contact layer 22*c* or 23*c* (see FIG. 9), respectively. In the present example, the contact material is plated as an inlay into the surface of the respective contact element, so that it can easily be covered by extrusion coating. Otherwise, different technologies for applying the contact material would also be conceivable. Instead of the two mating contact elements 22 and 23, only one mating contact element could, of course, also be provided in order to form a break contact or a make contact.

Figure 8:
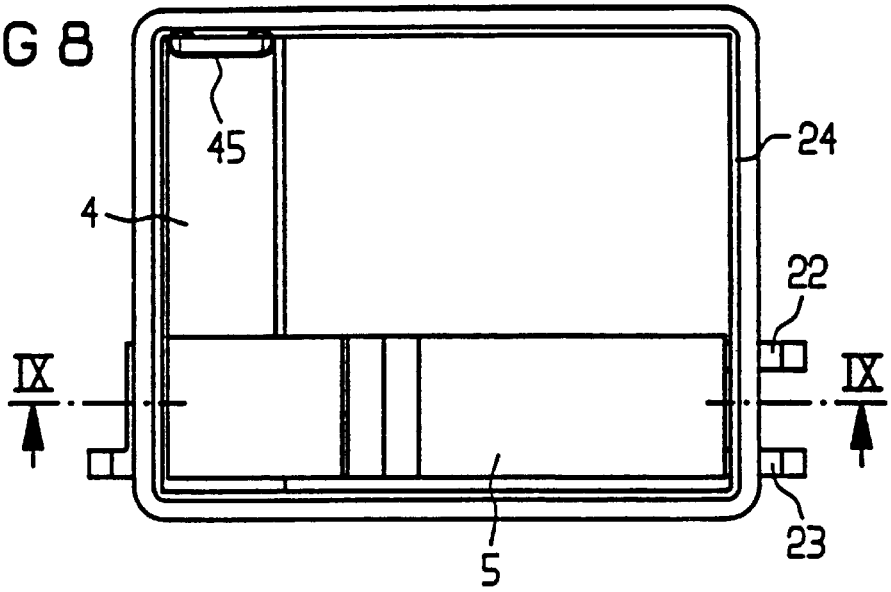
FIG. 8 shows a plan view of the second half-shell with the armature and with the contact spring fitted.
Figure 9:
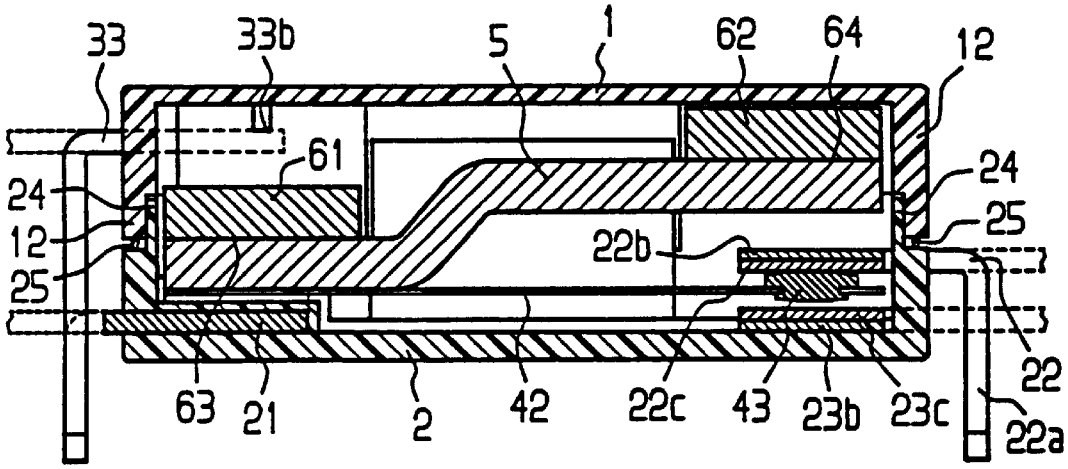
FIG. 9 shows a cross sectional view taken along line IX—IX of FIG. 8, but with a first half-shell additionally fitted.

The contact spring (FIG. 4), which is an L-shaped design, has a first spring limb 41 which extends at the end in front of the coil, as well as a second spring limb 42, which extends at the side alongside the coil underneath the armature and is fitted with a moving contact 43 (FIG. 6 or FIG. 9). The first spring limb 41 is attached via a fastening lug 44, which is bent upward, to the spring support 21 via a welded joint 46 according to FIG. 4 or via a clamping claw 45 according to FIG. 8. This connection technique means that the height at which the contact spring 4 is mounted on the spring support 21 is variable, which also means that it is possible to adjust the position of the second spring limb 42 with respect to the mating contact elements. In this way, it is possible to influence the armature restoring force and the force when the contact is in the rest state, during the assembly process, in order to compensate for the tolerances.

Before attaching the contact spring to the spring support 21, it is connected to the armature 5, which can be done in an electrically conductive manner, for example according to FIG. 6, via a welded joint 51. If there is intended to be insulation between the contact spring and the magnet system, then the connection can be produced by a dielectric sheath 52 according to FIG. 7. For certain applications, it is also possible for the current to the contact spring to be carried via a braid. Thus, for example, higher control levels can be carried via such a braid with low resistance to the contact point, in order to avoid excessive heating of the spring.

When the two half-shells 1 and 2 (see FIG. 9) are being joined together, a circumferential wall 12 engages like a box lid over the lower housing part 2 which, for this purpose, has a web 24 running round on the inside. In order to achieve accurate adjustment of the distances between the magnet system and the contact system, one of the housing parts also has a circumferential rib 25 which is deformed by means of ultrasound during the joining process and produces the sealed connection between the two half-shells. In this case, the seal-in voltage of the armature is measured while the two half-shells are being joined, the armature being attracted to the pole surfaces 63 and 64 of the pole plates 61 and 62. As soon as the seal-in voltage reaches a predetermined level as a measure of the amount of erosion or the overtravel of the contact, the joining process is ended. The relay is thus adjusted and at the same time sealed.

FIG. 10 shows a variant of the relay from FIG. 1. In this case, the two half-shells 101 and 102 are not connected in a single joint plane, but with mutually stepped joint planes 103 and 104. The internal construction of the relay is the same as in the previous example, apart from the fact that a mating contact element, namely a make-mating contact plate 105 is molded with its connecting pin 105*a* into the first half-shell with the magnet system. In this case, the distance between the mating contacts can be influenced during the process of joining the two half-shells. In this variant, an injection-molding mold without a slide can be used to provide both welded, riveted and inlay contacts on the mating contact elements.

By virtue of the use of relatively flat parts, the construction of the relay also permits other embodiments of the connection geometry, so that the connections can also emerge from the housing on only one relay side. Such an option is shown in FIG. 11, in which case a first half-shell 110 is fitted with the contact elements with connecting pins 111, 112 and 113, and a second half-shell 120 is fitted with the magnet system with the coil connecting pins 121 and 122. Such a relay requires only a small base area for plugging in or for soldering. A blader plug could, of course, also be provided instead of the solder connecting pins in FIG. 11. As has already been mentioned earlier, the connecting pins are, of course, also designed as SMD connections for surface mounting.

What is claimed is:

1. An electromagnetic relay comprising a first housing part, which is fitted with a coil having a core with two ends extending through the coil with the two ends forming two pole plates outside of the coil, a second housing part having at least one spring support and at least one mating contact element anchored therein, the spring support being fitted with a contact spring which interacts with the mating contact element and an armature which is connected to the contact spring and bridges the pole plates forming air gaps, each of the two housing parts being half-shells made of plastic and having a base with upstanding walls with edges, said two housing parts being joined together at the edges of the walls to form a sealed housing with connections for the coil windings and for the contact elements passing out through the walls of said respective housing parts and a main joint plane between the two housing parts extending at right angles to a switching movement of the contact spring, the coil including a coil former with a coil winding being embedded together with a portion of the core in the plastic of the first housing part with pole surfaces of the pole plate in the region of the air gaps being free of the plastic, and the spring support and at least one mating contact element being embedded in the plastic of the second housing part.

2. A relay according to claim 1, wherein the core is embedded in a plastic of a coil former.

3. A relay according to claim 2, wherein connecting elements for the coil winding are embedded both in the coil former and in the plastic of the first housing part.

4. A relay according to claim 1, wherein the coil has a coil axis and the core is U-shaped with a center section being fitted within the coil and the two pole plates projecting at right angles to the coil axis from one side of the coil, and the armature extending parallel to the coil axis on the one side of the coil with the two pole plates.

5. A relay according to claim 4, wherein the contact spring is cut in an L-shape, so that it has two limbs which lie in one plane, a first limb of the two limbs extends to an end of the coil and a second limb of the two limbs extends alongside the one side of the coil, said second limb and the armature being located in a stack and being connected in a corner region between the two limbs of the contact spring.

6. A relay according to claim 5, wherein the armature is connected to the spring via a common dielectric sheath.

7. A relay according to claim 1, which includes two mating contact elements being anchored in the second housing part and forming a changeover contact with the contact spring.

8. A relay according to claim 1, wherein a second mating contact element is anchored in the first housing part and forms a changeover contact with the mating contact element in the second housing part and with the contact spring.

9. A method of producing a relay which has a first housing part with a coil having a core passing through the coil with outer ends of the core forming pole plates being anchored in the housing part, a second housing part having anchored therein at least one spring support and at least one mating contact element, the spring support being fitted with a contact spring which interacts with the mating contact element and an armature being connected to the contact spring and bridging the pole plates forming air gaps, the method comprising the steps of producing the first housing part by embedding the coil with the core including coil connections therein; producing the second housing part by embedding the spring support and said at least one mating contact element therein, each of the housing parts being formed as trough-like half-shells with a base having upstanding walls with edges forming at least one main joint plane which extends at right angles to the movement direction of the armature, so that the contact spring which is connected to the armature is connected to the support structure; and then joining the edges of two housing parts to one another to complete a housing for the relay.

10. A method according to claim 9, which includes providing the coil with the core by embedding the core and the coil connections in a coil former, providing a coil winding on the former and then embedding the coil former with the coil winding in order to form the first housing part.

11. A method according to claim 9, which includes welding the armature to the contact spring and connecting the contact spring to the spring support.

12. A method according to claim 9, wherein the armature is connected to the contact spring by a dielectric sheath.

13. A method according to claim 9, wherein the contact spring is connected to the spring support by welding.

14. A method according to claim 9, wherein the contact spring is connected to the spring support by plug-in attachment.

15. A method according to claim 9, wherein the step of joining the two housing parts together includes measuring armature travel and/or overtravel and ending the joining process when a predetermined magnitude is reached.

16. A method according to claim 15, wherein edge regions of at least one of the two half-shells is deformed during the joining process until a predetermined overtravel is reached.

17. A method according to claim 16, wherein the step of forming one of the two half-shells provides a rib along the edge of the half-shell and the step of deforming the edge region includes deforming the rib by ultrasound during the joining process.

18. A relay according to claim 5, wherein the armature has a metallic connection to the contact spring, said connection being selected from a welded connection and a riveted connection.

19. A relay according to claim 1, wherein the walls of the two housing parts have different heights so that the edges of the walls lie in parallel offset planes.

* * * * *